United States Patent [19]

Kitano

[11] Patent Number: 5,000,826

[45] Date of Patent: Mar. 19, 1991

[54] METHOD OF JOINING METAL MEMBER TO RESIN MEMBER

[75] Inventor: Minoru Kitano, Nagoya, Japan

[73] Assignee: Far East Tooling Co., Ltd., Aichi, Japan

[21] Appl. No.: 456,177

[22] Filed: Dec. 26, 1989

[51] Int. Cl.[5] ..... C25D 1/20

[52] U.S. Cl. ..... 204/4; 204/38.7

[58] Field of Search ..... 204/4, 38.7

[56] References Cited

U.S. PATENT DOCUMENTS 4,053,370 10/1977 Yamashita ..... 204/15

FOREIGN PATENT DOCUMENTS 58-48698 3/1983 Japan .

OTHER PUBLICATIONS

IBM Technical Disclosure Bulletin vol. 14, No. 1, 6/71 p. 60.

*Primary Examiner*—T. M. Tufariello

*Attorney, Agent, or Firm*—Oliff & Berridge

[57] ABSTRACT

A method of firmly joining a metal member developed by electroforming to a resin member. A metal member having a roughened, sponge-like surface is formed by electroforming on an electroform matrix. Then, a resin such as epoxy is applied thereto to develop a first resin layer having a smooth surface. Further, another resin layer is formed on the first resin layer. The resin member is interlocked with the roughened, sponge-like surface for firm joining of the resin member to the metal member.

9 Claims, 4 Drawing Sheets

METHOD OF JOINING METAL MEMBER TO RESIN MEMBER

BACKGROUND OF THE INVENTION

1. Field of the invention

The invention relates to a method of joining a metal member to a resin member.

2. Prior art

The prior art to which this invention pertains includes a method of forming a rough surface on a metal member by means of etching, honing, applying molten metal, and so forth before resin is laminated thereon. In some cases, adhesive is employed to bond resin layers.

However, it has been pointed out that in the conventional methods, the joining strength between the rough surface and the resin is not sufficient.

A conventional method of joining a resin backing to a metal mold body developed by electroforming is discussed hereinafter to illuminate the problem of the prior art. The following is a manufacturing method of an electroformed mold. Firstly, a thin silver film a few microns thick, which provides conductance, is deposited by silver mirror reaction on the surface of an electroform matrix. The electroform matrix is then immersed in nickel plating solution. Secondly, the electroform matrix is connected with the anode of an electrical source while the nickel material for plating is connected to the cathode of the electrical source. Then, a predetermined level of electricity is loaded between the electrodes to deposit a metal layer on the electroform matrix, thereby forming a metal mold body. Further, backing resin is injected into or laminated on the metal mold body to obtain an electroformed mold reinforced by laminated resin on the back thereof.

This method, however, has a problem that the backing material for reinforcement easily separates from the metal mold body due to deformation caused by external heat or force. As the resin backing tends to separate from the metal mold body, the resin is unreliable as a reinforcement backing material. Hence, the metal mold body must be made thick.

SUMMARY OF THE INVENTION

The principal object of the invention is to provide a solution to the problem of the prior art described above.

Another object of the present invention is to provide a broadly applicable joining technique which can be employed to join a metal member to a resin member.

A further object of the present invention is to provide a method of increasing bond strength between a metal member and a resin member.

To achieve those objects, the present invention employs a method of joining a metal member to a resin member comprising the steps of electroforming a roughened, spongelike surface on a surface of the metal member and forming the resin member on the roughened, sponge-like surface of the metal member. Nickel, copper, or any other metal commonly employed for electroforming will suffice for the present invention.

Several methods of electroforming a roughened, spongelike surface are described below.

1. After an adhesive such as adhesive grease is applied to a surface of a metal member or a silver mirror surface of the electroformed mold, the surface is covered with powder made of hydrophobic insulating substance. Then, a spongy or mat-like (crater-like) metal layer is electroformed thereon.

2. The same as the method described above except that metal powder such as aluminum or iron powder is used instead of hydrophobic insulation substance.

3. A method of electroforming a roughened, spongy surface or the like by combination of the following steps; employing sulfamic acid containing impurities as a plating solution, applying a slightly stronger electric current for electroforming, and adjusting the pH level or temperature of the solution.

4. A method comprising blending uncharged nonconductive powder and non-conductive powder positively charged by a .previous treatment into plating solution.(-See Japanese Published Patent Application No. 58-48698)

There are other known methods of electroforming a roughened surface on a metal member. According to one method, a metal sheet manufactured by , for instance, rolling is electroformed. Another method comprises electroforming a metal member of predetermined thickness and further electroforming a roughened surface.

On the other hand, forming resin layers on a roughened surface can also be performed in various methods: applying adhesive and laying resin by hand; placing a mold on the roughened surface and injecting resin therein by vacuum forming.

The manner of operations of joining a metal member to a resin member of this invention is as follows: first, a metal member having a roughened, mat-like, or sponge-like surface is electroformed; a resin member is laminated, injected, or spread on the roughened, sponge-like surface.

This joining method allows the roughened, sponge-like surface formed on the metal surface to interlock firmly with the resin member formed thereon, thereby increasing bond strength between the metal member and the resin member.

DETAILED DESCRIPTION OF THE PREFERRED EMBODIMENTS

The present invention embodied in a method of molding metal to resin layers is described in connection with the drawings hereinafter.

Figure 1:
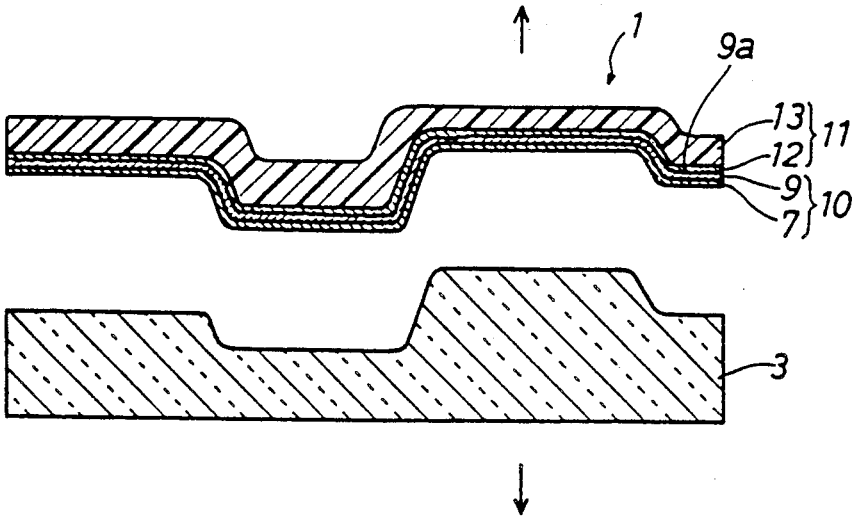
FIG. 1 is a sectional view of a metal body and an electroforming matrix in accordance with the preferred embodiment of the present invention.

FIG. 1 is a sectional view of the metal body with an electroforming matrix detached therefrom.

Figure 2A:
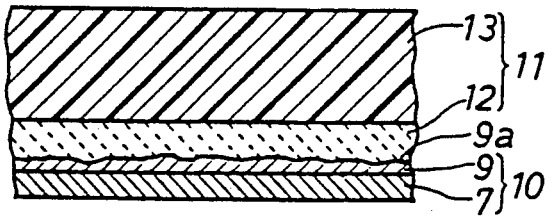
FIGS. 2(A) and (B) are enlarged partial sectional views of the metal mold.

FIGS. 2(A) and (B) are enlarged partial sectional views of the metal mold.

Indicated at 1 is a metal mold developed by electroforming while indicated at 3 is the electroform matrix.

As illustrated in FIG. 2, a metal mold body 10 comprises a first metal layer 7 and a second metal layer 9 having a roughened, sponge-like, or mat-like surface 9*a* formed thereon. FIG. 2 (B) is an enlarged partial view of the roughened, sponge-like surface 9*a*. Further, a reinforcement member 11 for reinforcing -the metal mold body 10 comprises laminations of a resin layer 12 and a glass fiber layer 13.

A method of manufacturing the metal mold 1 will be described below based on FIGS. 3 to 6 inclusive. First, the electroform matrix 3 is formed. A material for this electroform matrix 3 may be selected from commonly used materials including epoxy, acrylic, acrylic-butadiene, styrene copolymer, and other synthetic resins, solid wax, metals, wood, ceramics, cloth, thread, and so forth. In this embodiment, epoxy resin is employed.

In this step, a few microns thick metal film for conductivity is formed on the surface of the electroform matrix 3 by silver mirror reaction.

Second, nickel electroforming is performed as follows: the electroform matrix 3 having a metal film is immersed in a plating solution of Ni(Nickel)-sulfamate with or without a surface active agent mixed therein; the electroform matrix 3 is connected with a cathode while the nickel material is connected with an anode; electroforming is performed to deposit nickel on the metal film; thus, the first metal layer 7 is formed. In this step, the level of electricity used for electroforming is set at about 0.2 to 2 amps per 1 square decimeter so that the first metal layer 7 is made 1 to 1.5 mm thick.

Figure 4:
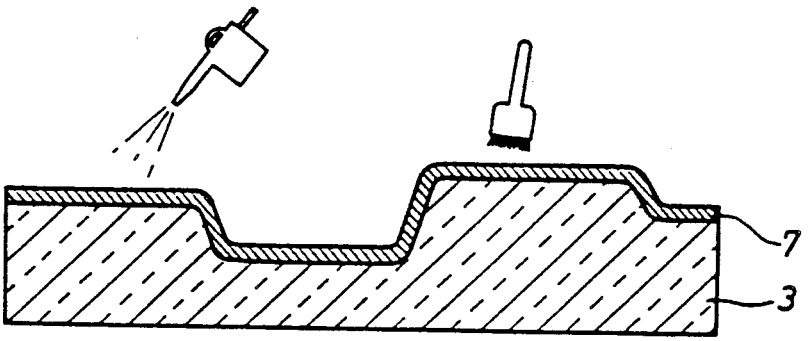

Third, the electroform matrix 3 is taken out of the solution and adhesive grease is brushed or sprayed onto the first metal layer 7 as shown in FIG. 4. Then, a hydrophobic insulation substance is applied thereto, which causes an oxidized film to develop on the surface of the first metal layer 7. An etching treatment is performed using hydrochloric acid or other suitable substances to remove the oxidized film.

Figure 2B:
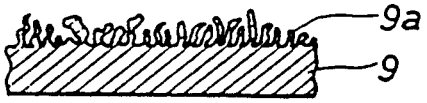
Figure 3:
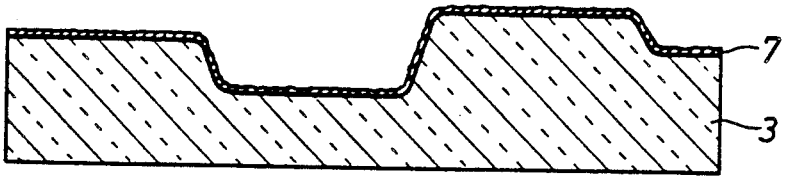
FIGS. 3 to 6 inclusive are illustration of the manufacturing process of the metal mold.
Figure 5:
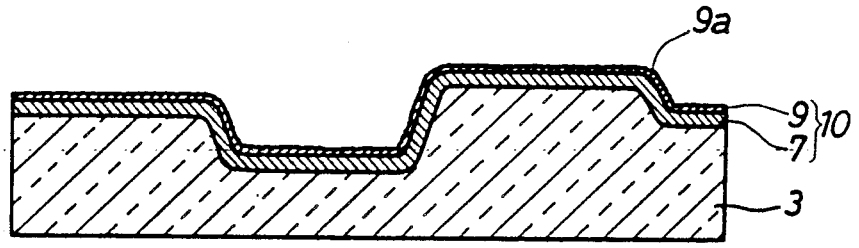

Fourth, electroforming is performed again in a vessel containing plating solution similar to the solution described above. In this step, a sulfamic nickel solution containing no surface active agent is used and 0.5 to 4 amps per 1 square decimeter is carried for a period of one to two days to obtain a second metal layer 9 which is 0.5 to 3 mm in thickness (FIG. 5). After this electroforming treatment, the roughened, sponge-like surface 9*a* has been formed on the metal layer 9 as illustrated in FIG. 2(B). In this embodiment, the roughened, sponge-like surface 9*a* is easily formed because a surface active agent is not mixed in the plating solution. Furthermore, as described above, hydrophobic insulation particles are applied to the first metal layer 7, which causes a roughened, sponge-like, mat-like surface to develop whereas in conventional electroforming, simple stick-like projections are developed.

Figure 6:
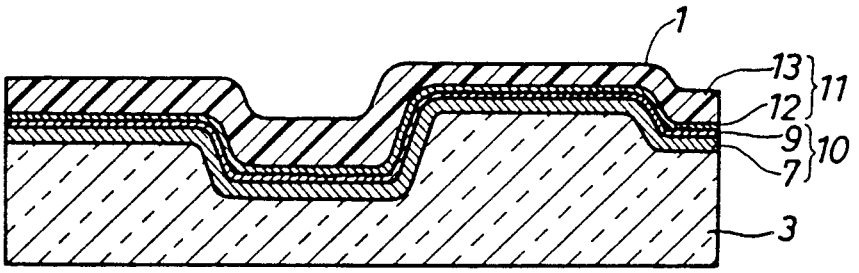

Fifth, the reinforcement member 11 is formed as a backing as illustrated in FIG. 6. Firstly, epoxy resin is applied by a brush etc., on the roughened surface 9*a*, forming a resin layer 12. The resin layer 12 smoothes the roughened layer 9*a*. Secondly, a fiber glass layer 13 is laminated thereon. The fiber glass layer 13 comprises four to five sheets of glass cloth containing epoxy resin. The reinforcement member 11 is now formed.

Finally, a heat treatment is performed at 40 degrees for around 7 to 8 hours in an electric furnace to increase mechanical strength such as tensile strength of the reinforcement member 11. Then, the electroform matrix 3 is removed from the metal mold 1 to complete the manufacturing process of the metal mold 1(FIG. 1).

Accordingly, in the above-described embodiment, the mat-like (spongy) surface 9*a* formed on the second metal layer 9 interlocks firmly with the resin layer 12, thereby increasing the bond strength between the metal body 10 and the reinforcement member 11 made of backing resin.

Moreover, the metal mold body 10 is so securely and firmly joined to the reinforcement member 11 that the metal mold 10 is made structurally strong. So the metal mold body 10 can be made thin and ,therefore, manufactured in a shorter period of time.

While the metal mold 1 of this embodiment is manufactured in the steps described above, for alternative embodiments, the following variation of steps may be added to or replace some steps included in the first embodiment.

1. The first metal layer 7 can be manufactured by other methods than electroforming described above.

2. The metal which comprises the metal layers 7 and 9 may be selected from any metals commonly employed for electroforming other than nickel.

3. After the formation of the first metal layer 7 made of nickel, the first metal layer 7 is plated with copper, which is easily activated, to prevent oxidation. Then, hydrophobic insulation substance is applied and the second metal layer 9 is formed. In this way, etching treatment can be simplified.

4. Metal particles may be used in place of hydrophobic insulation particles to form the roughened surface 9*a* on the second metal layer 9.

5. Insulation particles may be applied to limited parts of the metal mold 1 to concentrate the formation of a crater-like or honeycomb-like surface in certain areas so that the bond strength between the metal mold body 10 and the reinforcement member 11 is locally increased in those areas.

Figure 7:
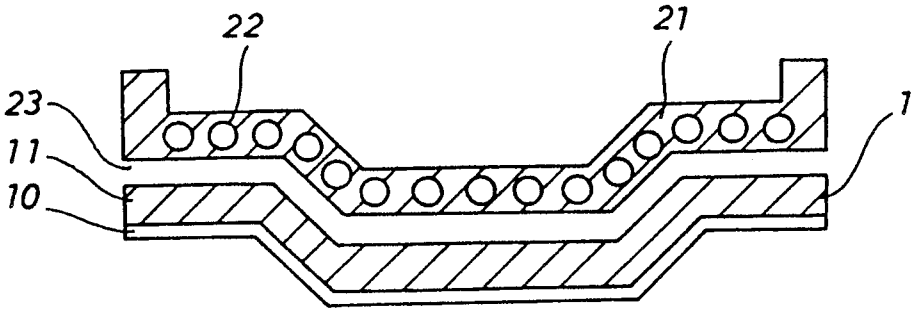
FIGS. 7 and 8 inclusive are cross-sectional side views of an application of the invention.
Figure 8:
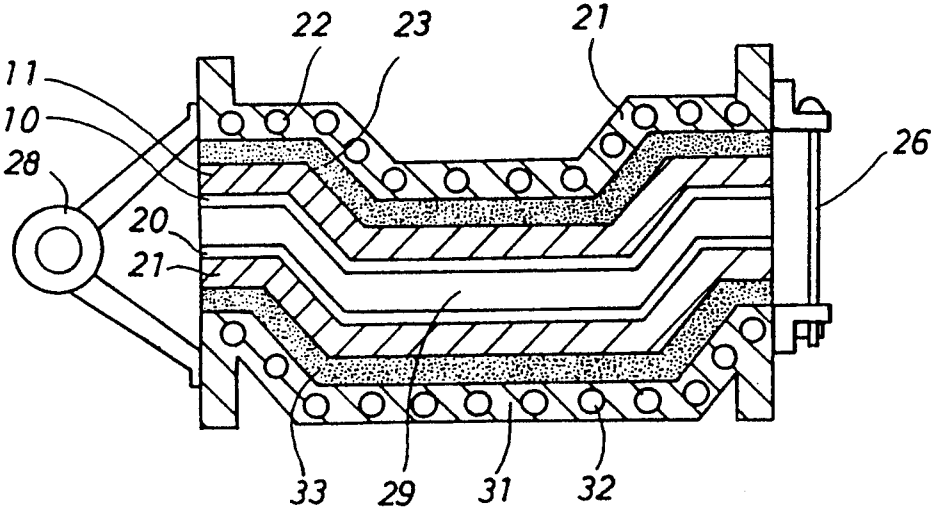

6. In an alternative embodiment, as shown in FIG. 7, an upper aluminum frame 21 may be held above the metal mold body 10 having a resin member 11 thereon so that a predetermined space 23 exists between the upper frame 21 and the resin member 11. A plurality of pipes 22 through which liquid is passed are provided in the upper frame 21 for controlling the temperature of adhesive epoxy resin injected into the space 23. Then as shown in FIG. 8, another metal mold body 21 having a resin member 20 is held above a lower aluminum frame 31 so that there is a space 33 between the lower frame 31 and the resin member 20. Like the upper frame 21, the lower frame 31 has a plurality of pipes passed therethrough to control the temperature of adhesive epoxy resin injected into the space 33. A hinge 28 and a clamp 26 are mounted on either end of the upper and the lower frames 21, 31. The clamp 26 has a bolt and a nut for opening and closing the aluminum frames 21, 31. The bolt and the nut may be replaced with an opening and closing means operated by oil-pressure to open and close the clamp. A cavity 29 is created between the metal mold body 10 and the metal mold body 20. Foaming plastic resin is injected into the cavity 29.

7. Although in the first embodiment, adhesive is used to increase the bond strength between the roughened, spongelike surface 9*a* and the reinforcement member 11, adhesive may be dispensed with in this step, depending on the use.

8. A metal layer having the roughened, sponge-like surface 9*a* may be electroformed directly on the metal film formed by silver mirror reaction on the electroform matrix 3. In the first embodiment, after the first metal layer 7 is formed, the second metal layer 9 having the roughened surface 9*a* is electroformed.

While the preferred embodiment described above is an application to a joining method using an electroformed mold, it is to be understood that modifications and variations may be made without departing from the spirit or scope of the invention as far as the method is employed to join a metal member and a resin member.

In accordance with the present invention, the roughened, sponge-like, mat-like surface formed on the second metal layer interlocks firmly and securely with the resin layer, thereby increasing the joining strength between the metal member and the resin member.

What is claimed is:

1. A method of joining a metal member to a resin member comprising the steps of:

(1) electroforming a roughened, sponge-like surface on a surface of a metal member by:

spreading adhesive on said surface of said metal member;

applying a hydrophobic insulation substance to the adhesive on said surface of said metal member;

introducing acid onto said surface of said metal member to create an etched surface of said metal member; and electroforming said etched surface to form a roughened, sponge-like surface on said metal member; and (2) forming a resin member on said roughened, spongelike surface of said metal member.

2. The method of claim 1, wherein metal particles are applied to the adhesive on the surface of the metal member instead of the hydrophobic insulation substance.

3. The method of claim 3 wherein the metal particles are chosen from the group of metal particles consisting of aluminum or iron power.

4. The method of claim 1 wherein the step of electroforming comprises the steps of:

immersing the etched surface in sulfamic solution that does not contain a surface active agent;

attaching a cathode to the etched surface;

inserting an anode in the plating solution; and applying a voltage across the cathode and anode.

5. The method of claim 2 wherein the step of electroforming comprises the steps of:

immersing the etched surface in sulfamic solution that does not contain a surface active agent;

attaching a cathode to the etched surface;

inserting an anode in the plating solution; and applying a voltage across the cathode and anode.

6. The method of claim 1 wherein the hydrophobic insulation particles are concentrated in predetermined areas of the metal member to increase a bond strength between the metal member and the resin member in the predetermined areas.

7. A method of joining a metal member to a resin member to form a metal mold comprising the steps of:

creating a first nickel layer on an electroform matrix by silver mirror reaction;

electroforming a second nickel layer on the first nickel layer to form the metal member;

etching a surface of the metal member to form an etched surface;

electroforming a third nickel layer on the etched surface of the metal member to form a surface having projections on the metal member;

introducing liquid resin onto the surface having projections such that the liquid surrounds the projections on the engaging surface;

allowing the liquid resin to set to form a resin member;

adhering a reinforcement member to the resin member;

heating the reinforcement member; and separating the electroform matrix from the metal member.

8. A method of joining a metal member to a resin member to form a metal mold comprising the steps of:

creating a first nickel layer on an electroform matrix by silver mirror reaction;

plating the first metal layer with copper;

applying a hydrophobic insulation substance;

electroforming a second nickel layer on the first nickel layer to form the metal member;

etching a surface of the metal member to form an etched surface;

electroforming a third nickel layer on the etched surface of the metal member to form a surface having projections on the metal member;

introducing liquid resin onto the surface having projections such that the liquid surrounds the projections on the engaging surface.

9. A method of joining a metal member to a resin member to form a metal mold comprising the steps of:

creating a first nickel layer on an electroform matrix by silver mirror reaction; and electroforming a second nickel layer on the first nickel layer to form the metal member, wherein the second metal layer has a roughened surface; and forming the resin member on the roughened, sponge-like surface of the metal member.

* * * * *